United States Patent [19]

Hämäläinen et al.

[11] 4,208,380

[45] Jun. 17, 1980

[54] PROCESS FOR THE RECOVERY OF COBALT FROM ITS IMPURE, AQUEOUS, IN PARTICULAR NICKEL-BEARING, SOLUTIONS AND CATALYST THEREFOR

[75] Inventors: Matti J. Hämäläinen, Kokkola; Jussi K. Rastas, Pori; Heikki A. Tiitinen, Ulvila; Tom O. Niemi, Öja, all of Finland

[73] Assignee: Outokumpu Oy, Helsinki, Finland

[21] Appl. No.: 922,762

[22] Filed: Jul. 7, 1978

[30] Foreign Application Priority Data

Jul. 15, 1977 [FI] Finland ..... 772210

[51] Int. Cl.[2] ..... C01G 51/10; C01G 51/12; C22B 23/04

[52] U.S. Cl. ..... 423/143; 423/517; 423/544; 423/592; 75/119; 252/439

[58] Field of Search ..... 252/416, 439, 440, 412; 423/143, 145, 517, 548, 544, 561 R; 75/108, 119

[56] References Cited

U.S. PATENT DOCUMENTS

| | | | |
|---|---|---|---|
| 2,728,636 | 12/1955 | Van Hare, Jr. et al. | 423/145 |
| 2,913,335 | 11/1959 | Dean | 423/143 |
| 3,967,957 | 7/1976 | Fonseca | 423/145 |
| 4,073,860 | 2/1978 | Huggins et al. | 423/561 R |

OTHER PUBLICATIONS

*Catalysis in Inorganic Hexammine Synthesis*, by H. F. Schaefer, publ: University Microfilms, Michigan–1953.

*Primary Examiner*—P. E. Konopka

*Attorney, Agent, or Firm*—Brooks, Haidt, Haffner & Delahunty

[57] ABSTRACT

Cobalt is recovered as a finely-divided and anhydrous salt from impure, nickel-bearing, aqueous solutions of cobalt, by exposing the aqueous solution to oxidation at an elevated temperature in the presence of ammonia and the respective ammonium salt, the formation of cobalt (III) hexammine ions is catalysed with activated carbon or solid sulfides, a cobalt (III) hexammine salt is crystallized from the solution, the salt is separated from the solution and pyrolysed to form a cobalt (II) salt, and the released ammonia is returned to the oxidation stage.

17 Claims, 5 Drawing Figures

17 Claims, 5 Drawing Figures

PROCESS FOR THE RECOVERY OF COBALT FROM ITS IMPURE, AQUEOUS, IN PARTICULAR NICKEL-BEARING, SOLUTIONS AND CATALYST THEREFOR

BACKGROUND OF THE INVENTION

The present invention relates to a process for the recovery of cobalt in the form of finely-divided and anhydrous salt from impure, aqueous, in particular nickel-bearing, solutions of cobalt, by exposing the aqueous solution to oxidation at an elevated temperature in the presence of ammonia and corresponding ammonium salt.

A process for producing a cobalt (II) salt by crystallizing it from a pure aqueous solution of the same is widely known. The aqueous solution from which the salt is crystallized is usually produced by dissolving a pure cobalt metal in an aqueous solution of the corresponding acid. A hydrous cobalt salt is obtained as a product of crystallization. It is not usually possible to obtain an anhydrous cobalt salt—e.g. cobalt sulfate—by crystallization performed at normal pressure and with solutions normally used.

It is highly advantageous to produce a pure and rapidly dissolving metallic cobalt powder suitable for the production of cobalt sulfate, as well as other cobalt chemicals and compounds, by the known pentammine process (W. Kunda, J. P. Warner, V. N. Mackiw, The Hydrometallurgical Production of Cobalt, Trans. Can. Inst. Mining Met., 65 (1972) 21–25); an impure, in particular nickel-bearing, sulfate solution or an ammoniacal sulfate solution is suitable as the raw material of this process. It can even be said that the dissolving of the cobalt powder produced by the pentammine process in a suitable acid and the crystallization or precipitation performed from the solution thus obtained represents the highest level of current technology for the production of pure cobalt chemicals and compounds from impure solutions of the type described above. It can further be noted that the most suitable and principal area of use for the cobalt powder produced by the pentammine process is obviously the production of cobalt chemicals and compounds. This is so because a finely-divided metal powder is usually not suitable for smelting operations and, furthermore, the cobalt powder produced by the pentammine process is usually too coarse or, owing to the production process, it has an over-high sulfur content for powder metallurgical applications.

An object of the invention is to provide a process for the production of cobalt sulfate from impure, in particular nickel-bearing, sulfate and ammoniacal sulfate solutions having the following advantages:

1. The cobalt sulfate is obtained directly without the necessity of producing metal as an intermediate product.

2. The cobalt sulfate is obtained directly in an anhydrous form without the necessity of resorting to special arrangements, such as calcination of a hydrous salt, autoclave crystallization, or the use of solutions with very high sulfuric acid concentrations.

3. The purity degree of the cobalt sulfate obtained as the product—as measured by the Co/Ni ratio—can easily be increased ten-fold.

4. The cobalt sulfate obtained as the product has a considerably smaller grain size.

5. The consumption of the reagent—especially the consumption of $NH_3$— is considerably smaller.

SUMMARY OF THE INVENTION

According to the invention the formation of cobalt (III) hexammine ions is catalysed with activated carbon or solid sulfides, a cobalt (III) hexammine salt is crystallized out of the solution, the salt is separated from the solution and pyrolysed to form a cobalt (II) salt, and the released ammonia is returned to the process, preferably to the oxidation stage.

DESCRIPTION OF THE INVENTION

Figure 1:
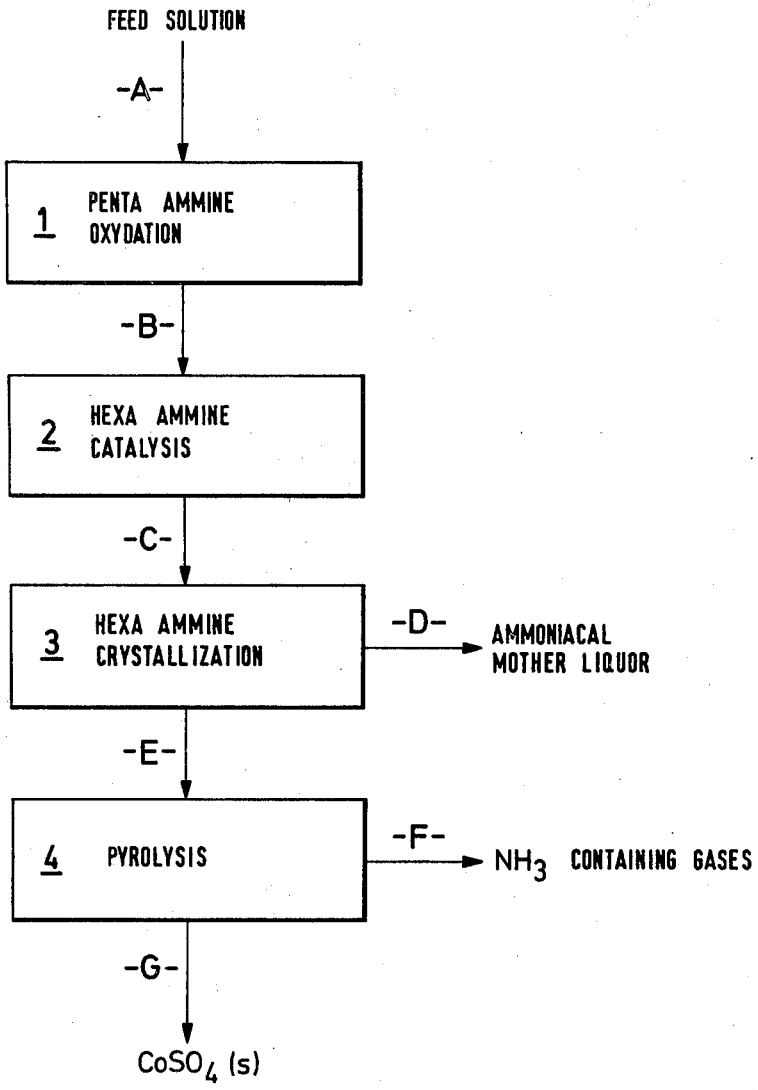
FIGS. 1–4 show, as flow diagrams, alternative embodiments of the invention.

The process to which the invention relates can be illustrated by considering the process as if divided into four separate stages which can in practice be, when so desired, combined in various ways and which are called hereinafter:

1. Pentammine oxidation
2. Hexammine catalysis
3. Hexammine crystallization
4. Pyrolysis For the sake of clarity only, in FIG. 1 the stages listed above have been conceived as operating separately. The operating principles of the stages are briefly as follows:

In the pentammine oxidation 1 the cobalt (II) present in the feed solution A is oxidized by a known method [(W. Kunda, J. P. Warner, V. N. Mackiw, Trans. Can. Inst. Mining Met. 65 (1962)21–25] to form a cobalt (III) pentammine complex.

In the hexammine catalysis 2 the cobalt (III) pentammine ion present in the product solution B from the pentammine oxidation 1 is catalysed by the process according to the invention, using either activated carbon or, preferably, a new easily produced catalyst invented by us, to form a cobalt (III) hexammine ion, $Co(NH_3)_6^{3+}$.

In the hexammine crystallization 3, cobalt is crystallized by commonly known crystallization methods as hexammine sulfate $[Co(NH_3)_6]_2(SO_4)_3.n\ H_2O$, E, from the product solution C of the hexammine catalysis 2, and on the basis of known solubility dependencies (I. Yu. Leshch, L. M. Frumina, F. M. Bernovska, Y. M. Shneerson, Zh. Prikl. Khim. 43 (1970) 1665).

In the pyrolysis 4, the hexammine sulfate E is decomposed thermally, by the dry method, in one or several stages, to form an anhydrous, finely-divided cobalt sulfate G.

The use of the byproducts of the process, shown in FIG. 1, i.e. the ammoniacal mother liquor D from the hexammine crystallization and the $NH_3$-bearing gases F from the pyrolysis 4, depends on the environment in which the process is carried out. The possibilities for the utilization of these byproducts will be illustrated later below with the aid of examples.

With reference to the examples given later in the test, our new observations which led to the process according to the invention are described below, our process is compared with the prior art already described above, the advantages of ourmethod over practices of prior art are pointed out and the wide range of possibilities for the application of our process are illustrated with the aid of examples.

Thermodynamic equilibrium calculations relating to the ammine complexes of cobalt show that under the conditions in which the pentammine oxidation 1 is performed, cobalt (III) hexammine complex is the only prevalent cobalt (III) ammine complex if an equilibrium between the complexes has been reached. Now, however, the formation of cobalt (III) hexammine complex under these conditions is kinetically prevented, whereas this is not the case as regards the lower ammine complexes of cobalt (III), which can easily be formed up to pentammine complex. The formation of the hexammine complex can, however, be promoted either by increasing the reaction affinity of Reaction (1)

$$Co(NH_3)_5^{3+}(aq)+NH_3(aq)\rightleftharpoons Co(NH_3)_6^{3+}(aq) \quad (1)$$

or by trying to circumvent the kinetic barrier to the reaction by using some suitable catalyst. The literature of the field shows that both methods have been used. The former method, in which the affinity of Reaction (1) has been increased by adding ammonia in excess, 9–15 moles for each cobalt and nickel mole in the feed solution, and by bringing the reaction solution to an elevated temperature, whereby an autoclave must be used as the reaction tank, has been disclosed in U.S. Pat. No. 2,728,636. The latter method has been described in several works dealing with hexammine synthesis, in which the salt has been intended for laboratory and research uses. A good picture of these works can be obtained in the book: H. F. Schaefer, Catalysis in Inorganic Hexammine Synthesis, University Microfilms, Michigan 1953. The catalysts then used include activated carbon, silicic acid gel, Raney nickel and silver diammide.

The disadvantages of the former of these methods include a high ammonia consumption and the need for an autoclave for Reaction (1), and those of the latter include the high price of some of the catalysts and the fact that all of the catalysts are substances foreign to the cobalt process, i.e. they cannot be generally produced in a cobalt-treating metallurgical or chemical production plant from the raw materials available from the actual production process and using the equipment at hand.

These drawbacks have been eliminated in the process according to our invention. This can be seen very clearly in Examples 1–4. They describe our novel and surprising observations, which show that a sulfide of cobalt, nickel or both, easily produced in cobalt-treating metallurgical or chemical production plants, is a novel, previously unknown catalyst which is suitable for the hexammine synthesis and is more effective than activated carbon.

Our observations have shown that the quality and the production method of the sulfides have not had any marked effect on the efficiency of the hexammine catalysis. We have experimented with, for example, sulfide precipitates which have been produced in a laboratory by means of ammonium sulfide, washed, and even dried, and then comminuted, and also with damp sulfide precipitates taken directly from operating hydrometallurgical process.

Furthermore, we have observed that there is a reduction reaction competing with the catalysis and producing bivalent cobalt in the solution. The reaction has been observed both in experiments carried out using an activated-carbon catalyst and in those carried out using a sulfide catalyst. This in itself is not surprising, considering the clear reducing ability and capacity of each catalyst under these conditions. Our experiments have, however, shown that the hexammine catalysis is under certain conditions a considerably more rapid process than the reduction reaction producing cobalt (II) ions.

On the basis of this result we strove consistently to develop simple and effective equipment in which, in addition to being easy to use, the difference between the rates of the said reactions is exploited. In practical applications, care had to be taken that the solution and the sulfide precipitate, which we had already found to be a better catalyst than activated carbon, were contacted with each other for only a very short time. On the other hand, in order to help the hexammine catalysis to proceed as far as possible, the total available surface area of the catalyst should be as large as possible.

In practice this led to a solution which can be implemented extremely simply and easily in production plants. We charged a normal filter press with a sulfide precipitate diluted with diatomite and then circulated the solution through it. By this procedure we could use an apparatus in which the retention time of the solution was about 15 min and its contact time with the catalyst bed in the order of 1–2 min to reach approximate yields of 95% in hexammine catalysis without marked reduction of cobalt to a bivalent state. The yield from the reduction reaction in these experiments was about 0.3%.

Examples 5 and 6 illustrate the observations we made in connection with our experiments concerning hexammine crystallization:

1. By means of hexammine crystallization the cobalt can be separated very efficiently not only from the nickel in the solution but also from the zinc, magnesium and other cations present in the solution.

2. By dissolving the hexammine sulfate in pure water and by recrystallizing it from the thus obtained solution we easily obtained products in which the Co/Ni ratio was in the order of 20,000.

The following series of reactions occurs in the pyrolysis of cobalt (III) hexammine sulfate:

$$3[Co(NH_3)_6]_2(SO_4)_3.nH_2O(s)\rightarrow 3[Co(NH_3)_6]_2(SO_4)_3.2H_2O(s)+3(n-2)H_2O(g) \quad (2)$$

$$3[Co(NH_3)_6]_2(SO_4)_3.2H_2O(s)\rightarrow 3[Co(NH_3)_6]_2(SO_4)_3.H_2O(s)+3H_2O(g) \quad (3)$$

$$3[Co(NH_3)_6]_2(SO_4)_3.H_2O(s)\rightarrow 3[Co(NH_3)_6]_2(SO_4)_3(s)+3H_2O(g) \quad (4)$$

$$3[Co(NH_3)_6]_2(SO_4)_3(s)\rightarrow 3Co_2(NH_4)_2(SO_4)_3(s)+N_2(g)+28NH_3(g) \quad (5)$$

$$3Co_2(NH_4)_2(SO_4)_3(s)\longrightarrow 6\,CoSO_4(s)+6NH_3(g)+3SO_3(g)+3H_2O(g) \quad (6)$$

$$3SO_3(g)\rightleftharpoons 3SO_2(g)+3/2O_2(g)$$

According to Reactions (2)–(6) and our observations made in connection with the experiments described in Examples 7 (reaction series), 8 (finely-divided state of $CoSO_4$) and 9 (finely-divided state of $Co_xO_y$), the following can be achieved by means of the pyrolysis (4):

1. A thermal conversion is obtained, i.e., trivalent cobalt is reduced to the bivalent state by thermal energy alone and with a very low $NH_3$ loss.

2. The intermediate product obtained is an anhydrous and finely-divided binary sulfate, $Co_2(NH_4)_2(SO_4)_3$, which itself is a completely novel commercial cobalt chemical or an intermediate product which is excellent for use as, for example, a raw material in cobalt metal production by autoclave reduction.

3. The cobalt sulfate produced by the pryolysis (4) is very finely-divided and is itself a completely novel commercial chemical with its numerous uses of them novel, and, in addition, being easy to transport, fully comparable with the cobalt powder produced by the pentammine process and even one grade purer than it, especially as regards nickel, and it can also be used as raw material for the production of cobalt chemicals and compounds which can be produced from cobalt sulfate or its solutions.

4. The finely-divided cobalt sulfate produced from hexammine sulfate by pyrolysis is a most suitable raw material in the production of really finely-divided cobalt oxides and, further, in the production, without intermediate grinding and by means of dry reduction, of really extra-fine cobalt powders which can be used in the raw material for hard metals.

Figure 2:
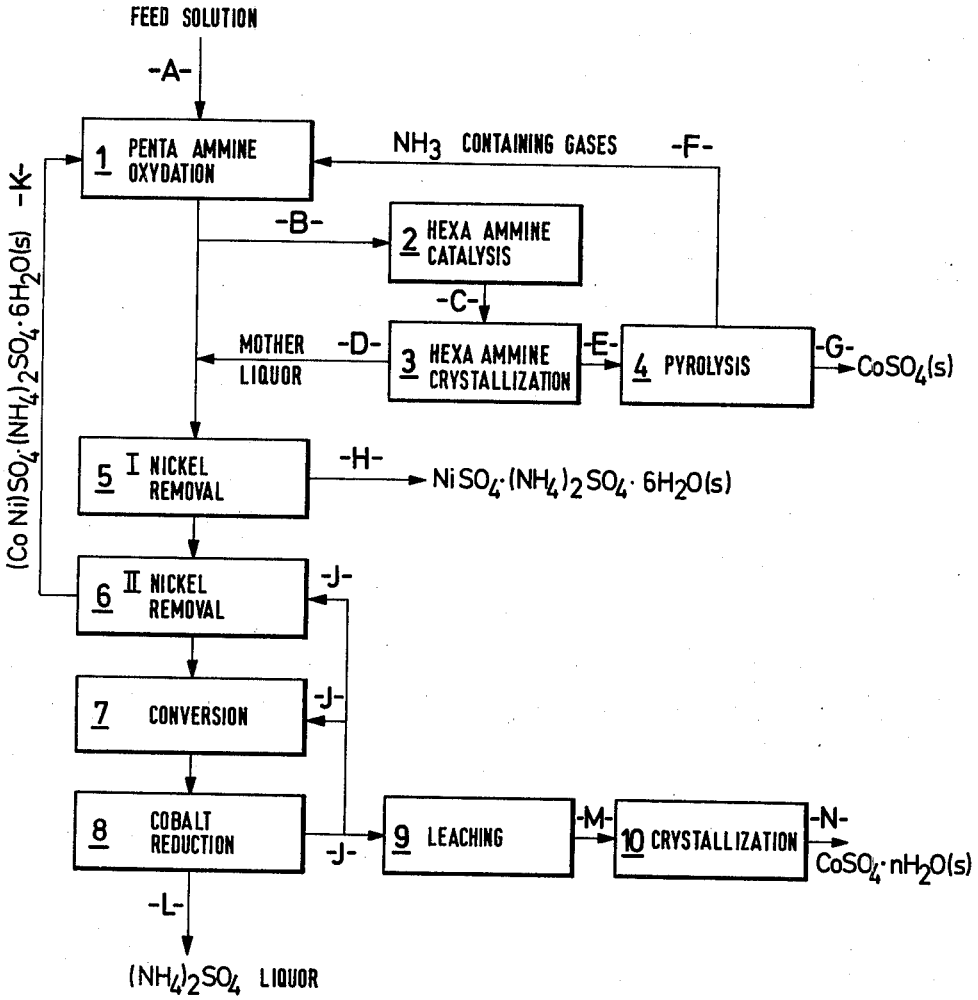

FIG. 2 illustrates another embodiment of our process, in which it is linked to a known pentammine process and in which it is used for producing a pure anhydrous and finely-divided cobalt sulfate from the impure intermediate product solution of the pentammine process. The symbols used in FIG. 2 are the same as those used in the process specification above and in FIG. 1. The pentamine process is represented, with the precision necessary in this context, by the following operations and symbols in FIG. 2:

The pentamine oxidation 1, in which cobalt is oxidized to form cobalt(III) pentamine complexes.

The I nickel removal 5, in which most of the nickel is extracted from the solution in the form of nickel ammonium sulfate H by the addition of $H_2SO_4$.

The II nickel removal 6, in which more nickel is removed from the solution to such an extent that the desired Co/Ni ratio, usually in the order of about 1000, is achieved by adding first a metallic cobalt powder J and thereafter sulfuric acid to the solution. The nickel co-crystallizes with the cobalt-ammonium sulfate K thus obtained, which is returned to the pentamine oxidation 1.

The conversion 7, in which the cobalt(III) pentammine complex present in the solution is reduced by means of the cobalt powder J to a cobalt(II) ammine complex and in which the $NH_3$/Co molar ratio in the solution is adjusted to approximately 2:1 using sulfuric acid.

The cobalt reduction 8, in which the cobalt(II) diammine complex is reduced to metallic cobalt powder J using gaseous hydrogen in an autoclave. A mildly ammoniacal $(NH_4)_2SO_4$ solution L containing some cobalt is produced as a byproduct of this stage.

The general process described above for the production of hydrous cobalt sulfate in a known manner from cobalt powder is represented in FIG. 2 by the process stages "leaching 9" and "crystallization 10". The advantages obtainable by the present process in view of the prior process appears from FIG. 2, i.e. $NH_3$ can be recycled, the product is free from crystal water and less capacity for reduction in an autoclave is required.

In the embodiment illustrated in FIG. 2, our process is conceived as being linked to the pentammine process in such a manner that part of the product solution B of the pentammine oxidation 1, which is a mutual stage, is fed to the hexammine catalysis 2 and that the mother liquor D from the hexammine crystallization 3 is returned to the I nickel removal 5 and further that the $NH_3$-bearing gases F from the pyrolysis 4 are returned to the pentammine oxidation 1.

The embodiment shown in FIG. 2 illustrates a case in which it is desired specifically to produce part of the cobalt present in the feed solution A in metallic form for use either as such or, for example, in the production of cobalt chloride and nitrate.

One of the disadvantages of the pentammine process is that the cobalt which has been oxidized to the trivalent state must be reduced, in the manner described above, back to the bivalent state using metallic cobalt powder during the conversion stage before the reduction of cobalt.

Figure 3:
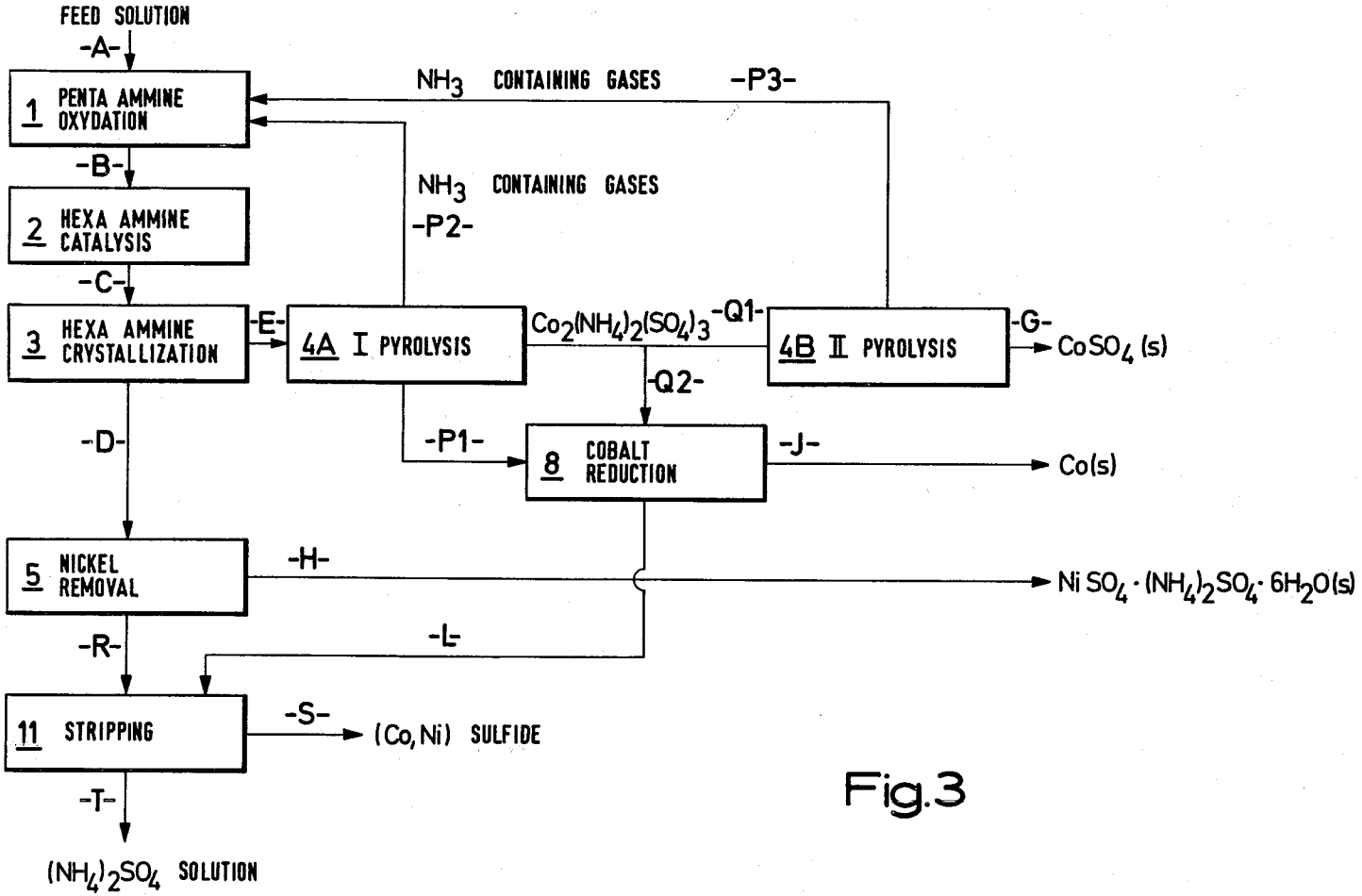

The following more advanced embodiment, which is illustrated in FIG. 3, shows how our process can be used to eliminate this drawback.

The symbols used in FIG. 3 are the same as those used in FIG. 1 except that the pyrolysis 4 has been conceived as being carried out in two stages. In the first stage of the pyrolysis, the I pyrolysis 4A, the hexammine sulfate E produced by the hexammine crystallizaton 3 is decomposed thermallly, by the dry method, to form a binary sulfate Q, $Co_2(NH_4)_2(SO_4)_3(s)$, in which the cobalt is thus bivalent as a result of "thermal conversion". Part of the binary sulfate Q1 passes on to the II pyrolysis 4B, in which it is further decomposed thermally to form cobalt sulfate G. Part of the binary sulfate Q2 is leached in water and the resultant solution is fed to the cobalt reduction 8, its $NH_3$/Co molar ratio first having been adjusted to a suitable value e.g. by means of the $NH_3$-bearing gases P1 produced by the I pyrolysis. The rest of the gases P2 from the I pyrolysis 4A plus the gases P3 from the II pyrolysis 4B are fed to the pentammine oxidation 1.

The mother liquor R from the nickel removal 5 is fed, together with the solution L produced as a byproduct of the cobalt reduction 8, to a stripping 11, in which the residual cobalt and nickel are removed from the process by known methods in the form of a sulfide precipitate S, which can be returned to the process which produces the feed solution A. The ammonium sulfate can be recovered by crystallization from the $(NH_4)_2SO_4$ solution T obtained as a byproduct of the stripping 11.

When the operation is performed according to our process illustrated in FIG. 3, the cobalt powder yield is at least 1.5 times that of the pentammine process, possibly even greater, even when using autoclaves of the same size. This is so because the stages, the II nickel removal 6 and the conversion 7, shown in FIG. 2, which consume the cobalt powder J produced by the process are eliminated and because the cobalt concentration in the cobalt reduction 8 can be raised to its practical maximum simply by regulating the water flow to the leaching of the binary salt Q2.

Figure 4:
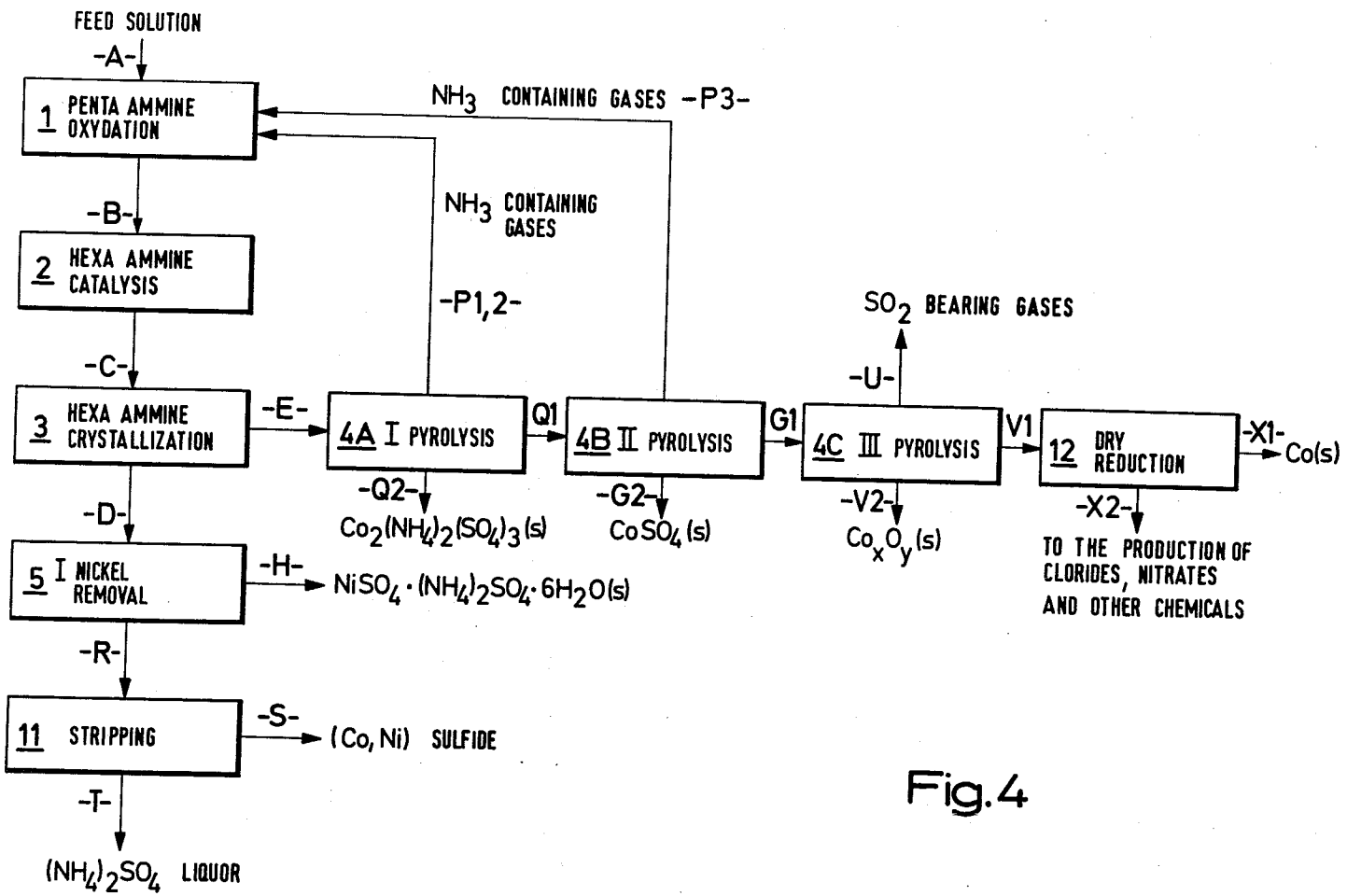

The following most advanced embodiment, which is illustrated in FIG. 4, shows how our process can be used for producing $Co_2(NH_4)_2(SO_4)_3$, $CoSO_4$, $Co_xO_y$ and finely-divided metallic cobalt. The symbols are the same as in FIG. 3 except that now the $NH_3$-bearing gases P1, 2 from the I pyrolysis 4A are all fed to the pentammine oxidation 1 and that part of the cobalt sulfate G1 is then fed to the III pyrolysis 4C, in which a finely-divided cobalt oxide V2 is produced in the manner illustrated by Reactions 7 and 8

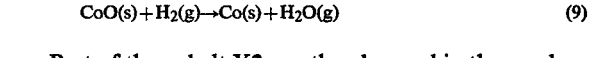

$$6CoSO_4(s) \rightarrow 2Co_3O_4(s) + 2SO_3(g) + 4SO_2(g) + O_2(g) \quad (7)$$

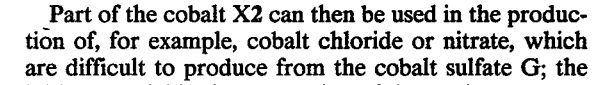

$$2Co_3O_4(s) \rightarrow 6CoO(s) + O_2(g) \quad (8)$$

A portion of the cobalt oxide V1 is then fed to the dry reduction 12, in which metallic cobalt X1 is produced according to Reaction 9

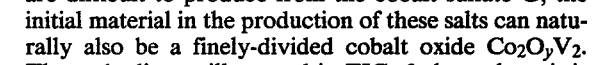

$$CoO(s) + H_2(g) \rightarrow Co(s) + H_2O(g) \quad (9)$$

Part of the cobalt X2 can then be used in the production of, for example, cobalt chloride or nitrate, which are difficult to produce from the cobalt sulfate G; the initial material in the production of these salts can naturally also be a finely-divided cobalt oxide $Co_2O_yV_2$. The embodiment illustrated in FIG. 2 shows how it is easy, by our process, to obtain an intergrated cobalt process which can be used for producing, from impure sulfate and ammoniacal sulfate solutions, any currently marketed and even novel cobalt chemicals, compounds and finely-divided cobalt oxides and metal powders at the desired and easily variable ratios.

Figure 5:
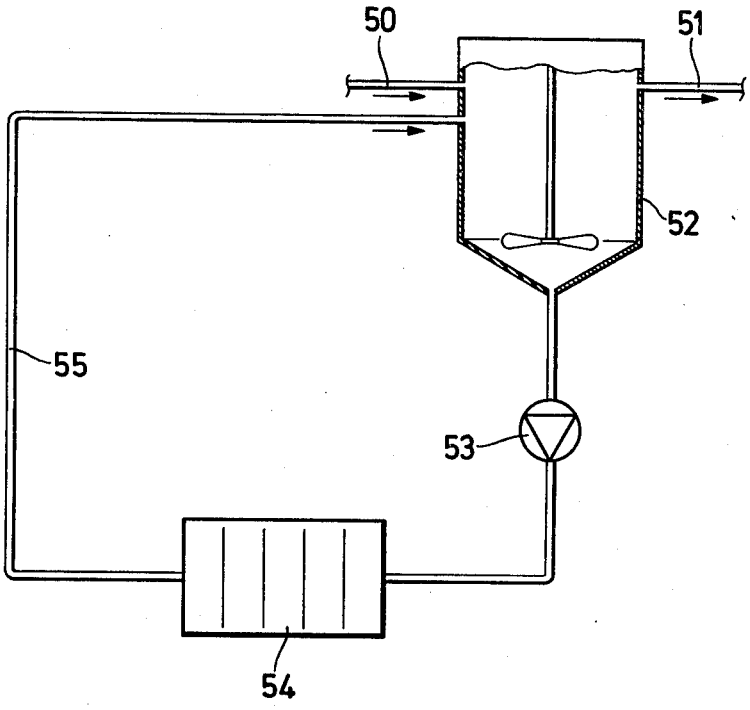
FIG. 5 shows a schematic side view of the apparatus intended for carrying out the process according to the invention.

FIG. 5 depicts an apparatus for carrying out the hexammine catalysis of the process according to the invention. In it the feed solution is fed along the pipe 50 into a mixing reactor 52 provided with an agitator; product solution is simultaneously withdrawn from the reactor 452 along the outlet pipe 51. The solution is circulated with the aid of a circulating pump 53 and a return pipe 55 through the filter press 54, which contains the catalyst, cobalt or nickel sulfide, and diatomite as a mixture in the form of a bed through which the solution flows, whereby cobalt(III) hexammine ions are produced.

EXAMPLE 1

Pentammine oxidation and hexammine synthesis were performed in the laboratory in a 1.5-liter batch reactor provided with an agitator. An initial synthetic solution was used in the experiment, the solution containing as sulfate about 25 g Co/l, about 25 g Ni/l, and about 120 g $(NH_4)_2SO_4$/l, plus ammonia in such a proportion that the molar ratio $NH_3/(Co+Ni)$ was about 5.5. The oxidation temperature was about 60° C. A 100-percent pure gaseous oxygen was used for the oxidation. The total pressure was about 1 bar. After four hours it was observed that 98% of the cobalt present in the solution was in the form of cobalt(III) pentammine ions.

The precipitate produced in the oxidation was separated by filtering, and (a) 100 g activated carbon and (b) 10 g of cobalt sulfide per one liter was added to the clear filtrate obtained. The temperature was then maintained at about 60° C. in both cases and the solution was agitated. After two hours it was observed that 98% of the cobalt present in the solution was in the form of cobalt(III) hexammine ions in both cases.

EXAMPLE 2

Hexammine synthesis experiments were performed in the laboratory in a closed 250-ml batch reactor provided with an agitator. The initial synthetic solution used for the experiments contained about 24 g $Co^{+3}$ (in the form of a pentammine complex)/l and about 120 g $(NH_4)_2SO_4$/l and also ammonia in such a proportion that the (total) molar ratio $NH_3/Co$ was about 7. The temperature was about 80° C. A comparison was made between the following catalysts.

| | Specific surface area ($m^2/g$) |
|---|---|
| (1) CoS | 2.7 |
| (2) NiS | 2.3 |
| (3) (Co,Ni)S | 4.1 |
| (4) Activated carbon | 951 |

The sulfides were produced from sulfate solutions by precipitation using ammonium sulfide. The sulfides were filtered, washed and dried, and then ground before being used in the experiments. In the Co-Ni sulfide the molar ratio Co/Ni was about 1. The amount of catalyst used in the experiments was 10 g per one liter of initial solution.

The following results were obtained:

| Reaction period (min) | Catalyst (1) CoS Yield (%) | (2) NiS Yield (%) | (3) (Co,Ni)S Yield (%) | (4) Activated carbon Yield (%) |
|---|---|---|---|---|
| 5 | 75 | 75 | 79 | not measured |
| 10 | 86 | 88 | 91 | 32 |
| 30 | 89 | 93 | 94 | 59 |
| 60 | 93 | 95 | 94 | 79 |

The yield (%) indicates the percentage yield from the reaction using hexammine catalysis.

The results show the efficiency of the metal sulfide catalysts.

EXAMPLE 3

Hexammine synthesis experiments were performed in the laboratory in a 1.5 liter batch reactor provided with an agitator. The initial solution used for the experiments originated in a related plant, from its pentammine oxidation stage and it contained approximately:

| | |
|---|---|
| 35 | g $Co^{3+}$/l (in pentammine complexes) |
| 11.3 | g Ni/l |
| 5.9 | g Mg/l |
| 4.6 | g Zn/l |
| 0.9 | g Na/l |
| 73 | g $(NH_4)_2SO_4$/l |

and also ammonia in such a proportion that the molar ratio $NH_3/(Co+Ni)$, where $NH_3$ stands for the total amount of ammonia bound in the complexes and free ammonia, was about 6.3. The temperature was 85° C. The following catalysts were experimented with.

(1) (Co,Ni)S (2) Activated carbon

The sulfide originated in the same related plant as the initial solution, and it was prepared from sulfate solution by $H_2S$ precipitation. The molar ratio Co/Ni in the sulfide was about 2. The catalyst amounts used in the experiments were: about 53 g (Co,Ni)S with a moisture content of about 55% and about 100 g of activated carbon per one liter of initial solution.

The following results were obtained:

| Reaction time (min) | Sulfide catalyst: Composition of product solution Co(total) (g/l) | Co(hex) (g/l) | $Co^{2+}$ (g/l) | Reaction yields % Hexammine synthesis | Reduction |
|---|---|---|---|---|---|
| 5 | 34.4 | 26.8 | 0.86 | 78 | 2.5 |
| 10 | 35.7 | 29.2 | 0.94 | 82 | 2.6 |
| 15 | 35.3 | 29.3 | 0.83 | 83 | 2.4 |
| 30 | 35.2 | 29.9 | 2.1 | 85 | 6.0 |

| Reaction time (min) | Activated carbon catalyst Composition of product solution Co(total) (g/l) | Co(Hex) (g/l) | $Co^{2+}$ (g/l) | Reaction yields % Hexammine synthesis | reduction |
|---|---|---|---|---|---|
| 15 | 35.8 | 20.7 | 1.1 | 58 | 3.1 |
| 30 | 36.6 | 31.7 | 0.92 | 87 | 2.5 |
| 90 | 36.7 | 33.8 | 1.1 | 92 | 3.0 |
| 180 | 38.7 | 34.7 | 3.4 | 90 | 8.8 |

The harmful reduction of cobalt can be observed from the experiments.

EXAMPLE 4

Hexammine synthesis was experimented with using the continuous-working apparatus according to FIG. 5. The volume of the mixing reactor 52 was about 3.3 l and the filtering surface area of the filter press was about 630 $cm^2$. The feed solution 50 used was the feed solution of Example 3 and the catalyst was the cobalt-nickel sulfide catalyst of Example 3, which, mixed with diatomite slurry, was batched into the filter press 54 before the beginning of the actual synthesis experiment.

Conditions and results of a typical trial run:
Temperature about 60° C.
Feed solution flow about 15 l/h
Catalysis circulation flow about 150 l/h
Retention time of the solution about 15 min
Reaction yield in hexammine synthesis about 95%
Reaction yield in reduction about 0.3%

It can be shown by calculations that the contact time of the solution with the catalyst was very short. In a typical experiment as described above the rate at which the catalysis circulaton flow 55 passed through the catalyst bed was about 0.7 mm/s and the thickness of the bed 5–10 mm, and the contact period of the solution with the bed was thus in the order of 1–2 min.

EXAMPLE 5

The product solution of the experiment described in Example 4 was cooled to 50° C. Thereby cobalt hexammine sulfate was crystallized from the solution, and the sulfate contained:

16.6% Co
0.01% Ni
0.009% Mg
0.005% Zn

It is observed that in the cobalt hexammine sulfate obtained the weight ratios Co/Ni, Co/Mg and Co/Zn were 1700, 1900 and 3300, whereas in the initial solution they were 3.1, 5.9, and 7.6 respectively.

EXAMPLE 6

When cobalt hexammine sulfate of the type described in Example 5 was leached in pure water and the obtained solution cooled, a cobalt hexammine sulfate was crystallized, its composition being:

16.8% Co
less than 0.001% Ni
less than 0.001% Mg
less than 0.001% Zn

It is observed that in the cobalt hexammine sulfate obtained the weight ratios Co/Ni, Co/Mg and Co/Zn were all above 17,000.

EXAMPLE 7

The pyrolysis of a cobalt hexammine sulfate produced by the method described in Example 5 was studied in the laboratory by known DTG and DTA methods, argon serving as the shield and carrier gas. In addition the composition of the products of decompositon was determined by chemical analyses and X-ray diffraction. It was observed that the pyrolysis of cobalt hexammine sulfate occurs in the following stages when the temperature is raised:

$$3[Co(NH_3)_6]_2(SO_4)_3.nH_2O(s) \rightarrow 3[Co(NH_3)_6]_2(SO_4)_3.2H_2O(s) + 3(n-2)H_2O(g) \quad (2)$$

$$3[Co(NH_3)_6]_2(SO_4)_3.2H_2O(s) \rightarrow 3[Co(NH_3)_6]_2(SO_4)_3.H_2O(s) + 3H_2O(g) \quad (3)$$

$$3[Co(NH_3)_6]_2(SO_4)_3.H_2O(s) \rightarrow 3[Co(NH_3)_6]_2(SO_4)_3(s) + 3H_2O(g) \quad (4)$$

$$3[Co(NH_3)_6]_2(SO_4)_3(s) \rightarrow 3CO_2(NH_4)_2(SO_4)_3(s) + N_2(g) + 28NH_3(g) \quad (5)$$

$$3Co_2(NH_4)_2(SO_4)_3(s) \longrightarrow 6\,CoSO_4(s) + 6NH_3(g) + 3SO_4(g) + 3H_2O(g) \quad (6)$$

$$3SO_4(g) \rightleftharpoons 3SO_2(g) + 3/2O_2(g)$$

Reaction (2) started if n was, for example 6, even at room temperature and ended at about 140° C. in our experiments. Reactions (3) and (4) occurred within the temperature range 150°–250° C., Reaction (5) within the temperature range 220°–330° C., and Reaction (6) within the temperature range 300°–440° C.

EXAMPLE 8

Cobalt hexammine sulfate crystallized in the experiment described in Example 5 was pyrolysed at 680° C. for 2 hours. The product obtained was anhydrous $CoCO_4$, which was found by X-ray diffraction analysis to be $\beta$-$CoSO_4$. The chemical analysis of this product was Co=37.7%, Ni=0.02%

The sieve analysis of the $CoSO_4$ was
+200 mesh 2.3%
200–400 mesh 2.7%
−400 mesh 95.0%

EXAMPLE 9

$CoSO_4$ produced in the experiment described in Example 8 was pyrolysed in a chamber furnace at 1100° C. for 2 hours. The product obtained was cobalt oxide with a cobalt content of 76.4% and a specific surface area of 9400 $cm^2/g$.

EXAMPLE 10

A combined oxidation and hexammine synthesis was performed in a laboratory autoclave as a batch process. The volume of the batch was 1.5 l and its composition was as follows:

$Co^{2+}$: 77.4 g/l (as sulfate)
$Co^{3+}$: 1.1 g/l
$Ni^{2+}$: 28.2 g/l (as sulfate)
$NH_3$: 222 g/l
$(NH_4)_2SO_4$: 180 g/l The mole ratio $NH_3/(Co+Ni)$ was thus about 7.2.

5 g precipitated cobalt sulfide was added to the batch and its temperature was raised to 75° C. and maintained at this temperature for 4 hours. 100% oxygen gas having a pressure of 5 bars was used for the oxidation.

Finally the orange colored hexammine sulfate crystals were filtered off the mother liquor which contained:

18.1 g $Co^{3+}$hexammine as a complex/l
1.8 g $Co^{3+}$pentammine complex/l
0.42 g $Co^{2+}$/l It was noted that about 75% of the cobalt(II) in the charge had been converted to a solid cobalt(III) hexammine sulfate.

EXAMPLE 11

This experiment was carried out as in Example 1 b, except that the following sulfides were used as catalysts: (a) Fe−, (b), Cu−, (c) As−, and (d) Mo-sulfides.

After 2 hours it was noted that of the cobalt(III) contained by the solution (a) 40%, (b) 90%, (c) 30%, and (d) 40% was in the form of cobalt(III) hexammine.

We claim:

1. A process for the recovery of cobalt as a finely-divided and anhydrous salt from impure aqueous solutions of cobalt, comprising subjecting the aqueous solution to oxidation at an elevated temperature in the presence of ammonia, an ammonium salt, and a metal sulfide catalyst promoting the formation of cobalt(III) hexammine ions to form cobalt(III) hexammine salt, crystallizing a cobalt(III) hexammine salt out of the solution, separating the salt from the solution, pyrolysing the separated salt to form a cobalt(II) salt and ammonia, and recycling the released ammonia to the process.

2. The process of claim 1, in which 4.5–6.5 moles of ammonia and 0.5–1.5 moles of ammonium sulfate per each cobalt and nickel mole are added to the aqueous solution.

3. The process of claim 1 in which the elevated temperature and the partial pressure at which the solution is subjected to oxidation are, respectively, 25°–90° C. and 0.2–5 bar.

4. The process of claim 1, in which the catalysis on the oxidized solution is performed at 25°–90° C., and at normal pressure.

5. The process of claim 1, in which the oxidation and the catalysis are performed during the same stage.

6. The process of claim 1, in which the crystallization of the cobalt(III) hexammine salt is performed by cooling the solution to below about 15° C.

7. The process of claim 5, in which ammonia is added to the crystallization stage in order to lower the solubility of the cobalt(III) hexammine salt.

8. The process of claim 1, in which the cobalt(III) hexammine salt is pyrolysed within the temperature range 250°–400° C. in order to produce $CO_2(NH_4)_2SO_4$.

9. The process of claim 1, in which the cobalt(III) hexammmine salt is pyrolysed at a temperature of from 400° C. to 750° C. in order to produce $CoSO_4$.

10. The process of claim 1, in which the cobalt(III) hexammine salt is pyrolysed at a temperature of from 750° C. to 1200° C. in order to produce cobalt oxide.

11. The process of claim 1, in which the aqueous solution is caused to flow through a bed of the catalyst.

12. The process of claim 11, in which the catalyst is mixed with an auxiliary substance, such as diatomite, in order to improve the ability of the catalyst to allow a flow through it.

13. The process of claim 1, in which the released ammonia is recycled to the oxidation stage.

14. A process according to claim 1 comprising adding to the impure aqueous cobalt solution a sulfide compound more easily soluble in the aqueous solution than cobalt and nickel sulfide.

15. The process of claim 1, in which ammonium sulfide or hydrogen sulfide or both are added to the aqueous solution before the use of the sulfide as a catalyst or at the time the sulfide is to be used as a catalyst.

16. The process of claim 1, in which the metal sulfide is cobalt or nickel sulfide or a sulfide of both nickel and cobalt.

17. The process of claim 4, in which the catalysis is performed at 50°–75° C.

* * * * *